United States Patent [19]

Sukolics

[11] Patent Number: 4,562,680

[45] Date of Patent: Jan. 7, 1986

[54] BUILDING BUTT GLAZING SYSTEM AND METHOD FOR BUTT GLAZING

[76] Inventor: Ronald D. Sukolics, 1637 Fairhills Dr., St. Louis, Mo. 63146

[21] Appl. No.: 598,264

[22] Filed: Apr. 9, 1984

[51] Int. Cl.[4] ..... E04B 2/88

[52] U.S. Cl. ..... 52/403; 52/235; 52/483

[58] Field of Search ..... 52/403, 393, 397, 402, 52/235, 483, 488, 463, 464

[56] References Cited

U.S. PATENT DOCUMENTS

| | | | |
|---|---|---|---|
| 3,435,579 | 4/1969 | Horgan | 52/235 X |
| 3,672,107 | 6/1972 | Santry et al. | 52/235 |
| 3,797,191 | 3/1974 | Sukolics | 52/235 X |
| 3,866,374 | 2/1975 | Dallen | 52/235 X |
| 3,968,608 | 7/1976 | Swango | 52/235 |
| 3,978,629 | 9/1976 | Echols | 52/235 |
| 4,214,415 | 7/1980 | Sukolics | 52/403 X |
| 4,377,926 | 3/1983 | Coulston et al. | 52/403 X |

*Primary Examiner*—J. Karl Bell

*Attorney, Agent, or Firm*—Bachman & LaPointe

[57] ABSTRACT

A building butt glazing system having a plurality of closely spaced adjacent panels secured to structural members by an adhesive, a method and apparatus for sealing the space between the closely spaced adjacent panels from the interior of the building employing a removable mullion insert having one end removably secured into a slot provided in the structural members and another end provided with a sealing material for sealing the space between the adjacent panels.

13 Claims, 3 Drawing Figures

BUILDING BUTT GLAZING SYSTEM AND METHOD FOR BUTT GLAZING

BACKGROUND OF THE INVENTION

The present invention relates to a building butt glazing system and, more particularly, a method and apparatus for sealing the space between adjacent panels in a building butt glazing system.

The term "butt glazing system" describes panel wall systems, usually glass, in which the vertical mullion structures do not extend through the wall. In typical butt glazing systems the entire mullion is on the interior of the wall. Once the glazing material is located in place, structural silicone sealant is gunned into the voids between the interior face of the panels and the exterior face of the structural mullion and allowed to cure. A bead of a similar structural silicone is then applied in the space between the adjacent panels to form a weather-tight seal against air and water. A typical prior art butt glazing system is shown in FIG. 1.

While the above known prior art building butt glazing systems are aesthetically in demand, high installation costs place the systems outside of typical construction budgets. The high installation costs are due to the fact that the bead of structural silicone sealant which is applied to the space between the adjacent panels must be applied from the exterior of the building which requires that exterior scaffolding be erected which otherwise would not be required as all other glazing operation may be accomplished from the interior of the building. In addition to the foregoing, since the exterior seal is made by injecting the silicone sealant in the space by means of a caulking gun, the appearance and integrity of the joint is dependent upon the skill of the workman applying the sealant.

Naturally, it is highly desirable to develop an improved building butt glazing system wherein the entire system may be installed from the interior of the building in a simple, efficient, economic and satisfactory manner.

Accordingly, it is a principal object of the present invention to provide an improved butt glazing system wherein the entire system may be installed and glazed from the interior of the building.

It is a principal object of the present invention to provide a removable mullion insert having a gasket preformed thereon for sealing the space between adjacent panels in a butt glazing system.

It is a further object of the present invention to provide an improved butt glazing system having an improved mullion structure for receiving the removable mullion insert.

Further objects and advantages of the present invention will appear hereinbelow.

SUMMARY OF THE INVENTION

In accordance with the present invention the foregoing objects and advantages are readily obtained.

The present invention relates to a building butt glazing system and, more particularly, a method and apparatus for sealing the space between adjacent panels in a building butt glazing system wherein the entire system may be installed and glazed from the interior of the building. In accordance with the present invention, a building butt glazing system wherein a plurality of closely spaced adjacent panels are secured to structural members by structural silicone sealant or other suitable adhesive comprises a structural member formed with a semi-circular slot in the front wall thereof wherein the slot receives a removable mullion insert having a gasket preformed on one end thereof for sealing the space between the adjacent panels. The removable mullion insert comprises an elongated member being provided with securing means on one surface thereof for removably securing the insert in the semi-circular slot provided on the structural mullion and sealing means are provided on another surface of the removable mullion insert spaced from the said one surface for sealing a space between the adjacent panels. In accordance with the particular embodiment of the present invention the removable mullion insert comprises an elongated substantially T-shaped member having three short legs and one long leg wherein the securing means for securing the insert in the semi-circular slot in the mullion comprises the three short legs which are rotatably received in the semi-circular slot. The sealing means is secured to the one long leg of the substantially T-shaped member. In accordance with the method of the present invention first, second and third vertical structural members are provided in spaced apart relationship along a straight line. A first panel is placed relative to two of the structural members. The removable mullion insert for sealing the space between said adjacent panels is then mounted in the semi-circular slot provided on the structural member and rotated such that the sealing preform provided on one end of the mullion insert abuts the edge of the first panel member. A second panel member is then located in place relative to the structural members adjacent to the first panel member such that the edge of the second panel member abuts and compresses the seal provided on the mullion insert so as to form a weather-tight seal between the panels.

In accordance with the present invention the panel members may be readily installed from the interior of the building thereby resulting in reduced construction costs. The removable mullion insert is readily accepted by the structural member without the need of securing means for holding the mullion insert in place.

The rotating nature of the insert allows the gasket to center itself between the two adjacent panels thereby guaranteeing equal sealing pressure against both panels. The insert also compensates for any misalignment which might result between the panels due to size tolerances.

DETAILED DESCRIPTION

Figure 1:
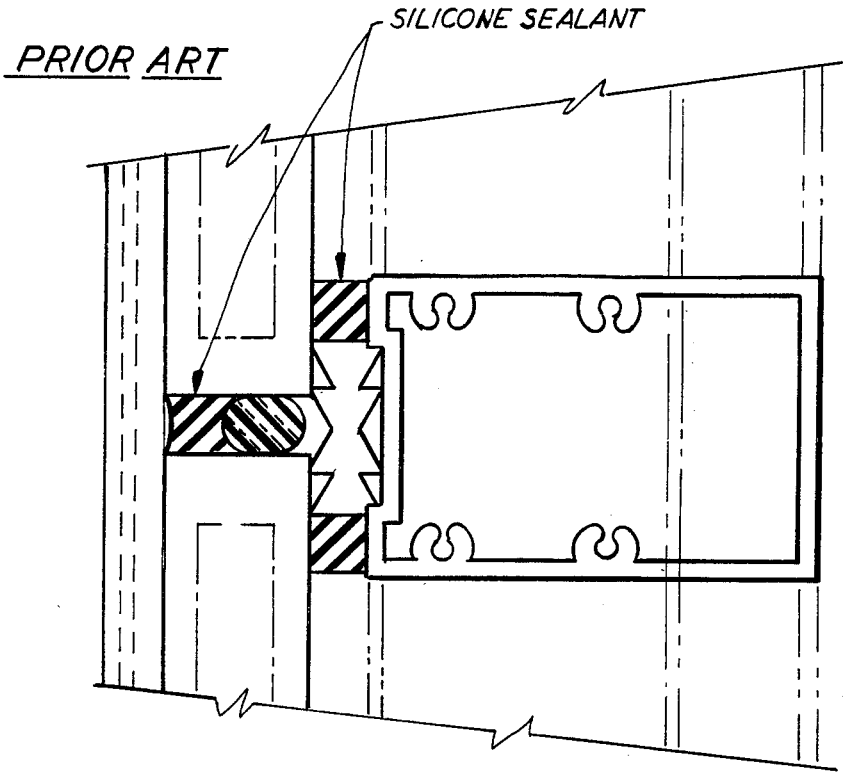
FIG. 1 is a sectional view of a typical building butt glazing system known in the prior art.
Figure 2:
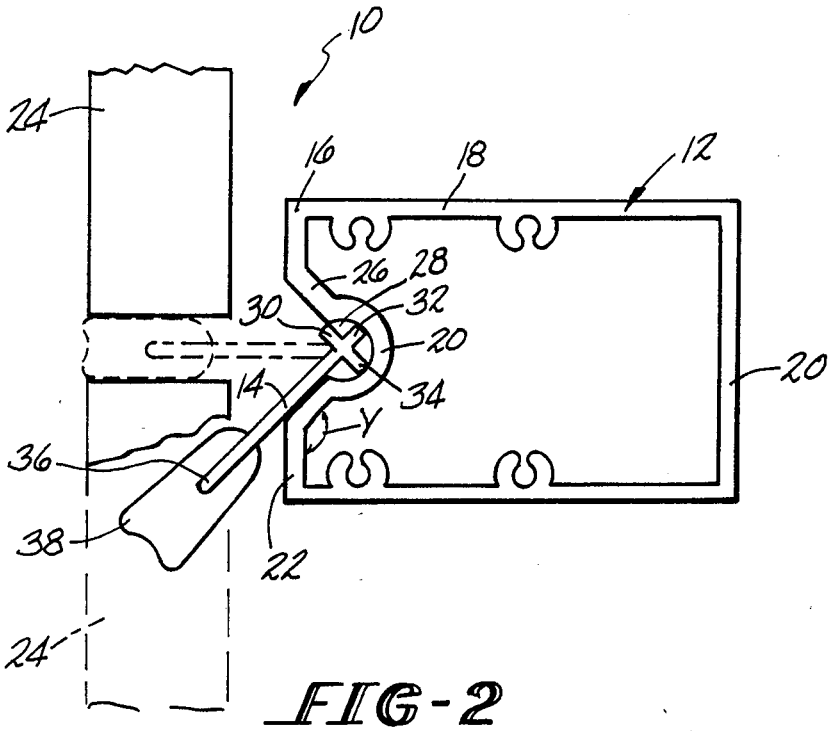
FIG. 2 is an illustration of the butt glazing system of the present invention employing the removable mullion insert of the present invention for sealing the space between adjacent panels in a building butt glazing system.

With reference to the figures, FIG. 2 shows the building butt glazing system 10 of the present invention. The butt glazing system comprises a vertical mullion 12 and a removable mullion insert 14. In accordance with the present invention the vertical mullion 12 has a front wall portion 16, a pair of sidewalls 18 and a back wall 20. The front wall portion 16 of the mullion 12 comprises a first pair of opposed sections 22 which extend from the sidewalls 18 toward each other in a plane substantially parallel to the plane made by the adjacent panels 24 which are to be glazed. A second pair of angled sections 26 extend from the first pair of opposed sections 22 toward the back wall portion 20 of the mullion 12 so as to form an obtuse angle Y between the first pair of opposed sections 22 and the second pair of angled sections 26. A radial section 28 in the form of a semi-circular slot which extends the entire length of the mullion connects the second pair of angled sections so as to define a semi-circular slot in the front wall portion of the mullion facing the adjacent panels 24.

In accordance with the specific features of the present invention the obtuse angle Y formed between the first pair of opposed sections and the second pair of angled sections should be greater than 135° so as to allow for the insertion of the removable mullion insert 14 in the semi-circular slot 28 provided on the vertical mullion structure. In accordance with the present invention the removable mullion insert comprises an elongated T-shaped member the length of which is equal to the length of the vertical mullion. The elongated substantially T-shaped member comprises a first securing portion formed by the three short legs 30, 32 and 34 of the T-shaped member. The one long leg 36 has preformed thereon a gasket 38 which, after the removable mullion insert is located in place, seals the space between the adjacent panels 24. In accordance with the present invention the elongated substantially T-shaped member may be formed of any suitable material such as plastic, aluminum or the like. The preformed gasket 38 likewise may be made of any suitable gasketing material such as neoprene, polyurethane, polyvinylchloride, etc.

Figure 3:
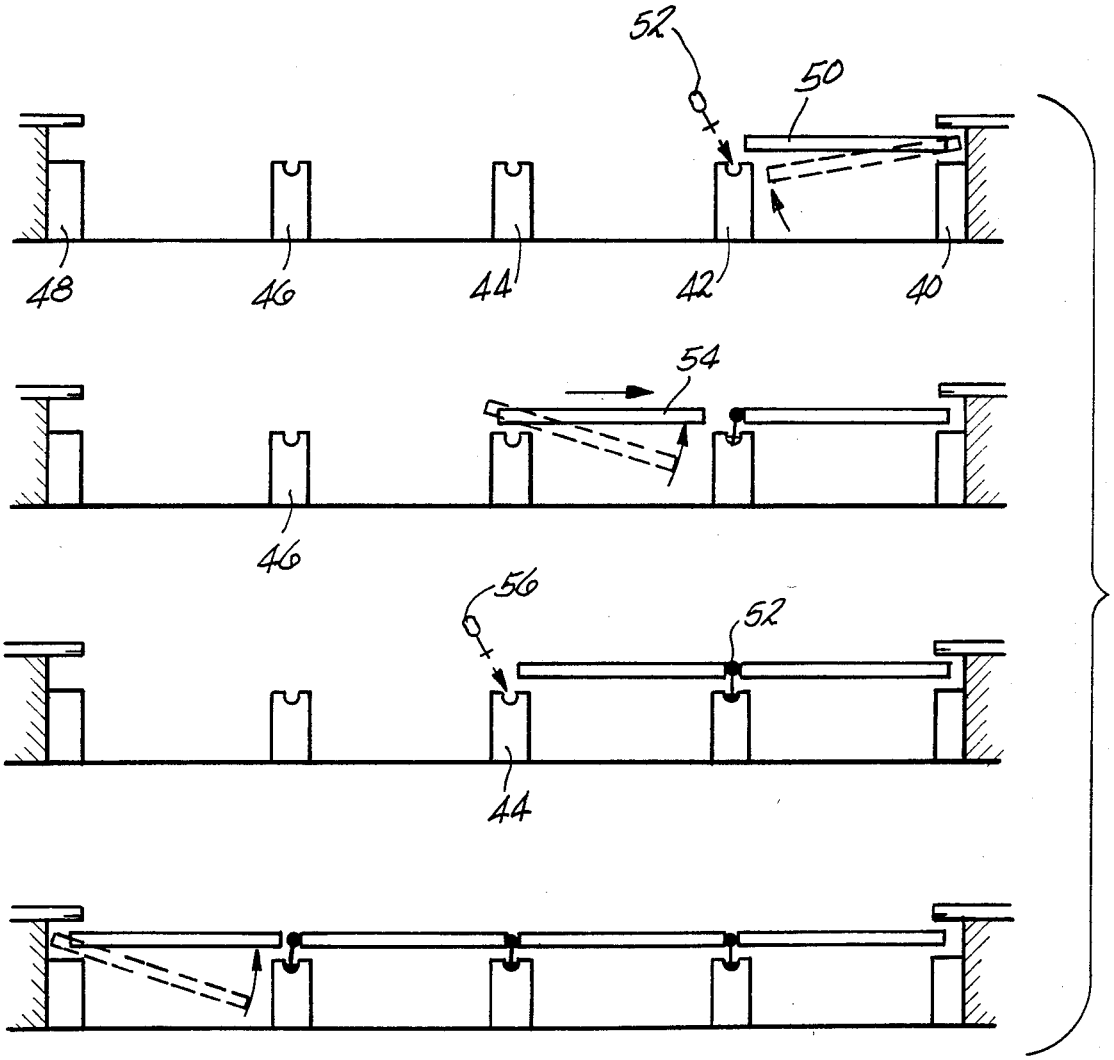
FIG. 3 is a schematic illustration of the method of sealing the space between adjacent panels in a butt glazing system in accordance with the present invention.

With reference to FIG. 3 the method for sealing the space between closely spaced adjacent panels in a butt glazing system in accordance with the present invention will be described. In accordance with the method of the present invention a plurality of vertical mullion structures 40, 42, 44, 46 and 48, respectively are positioned in place along a straight line. The vertical mullions are of the type described with regard to FIG. 2 and are illustrated schematically in FIG. 3. A first panel 50 to be glazed is located in place relative to the end mullion 40 and the first interior mullion 42. The panel is located in place from the interior of the building. Once the panel 50 is located in place a first removable mullion insert 52 is inserted in the semi-circular slot provided in the structural mullion 42. The mullion insert is inserted in place by placing two of the short legs 32 and 34 in the semi-circular slot (see FIG. 2 the insert 14 as shown in solid lines). The mullion insert is then located such that short leg 30 is located into semi-circular slot 28 and the gasket preform 38 on the insert abuts the first panel 50, as illustrated in phantom in FIG. 2. A second panel 54 is then located in place relative to structural mullions 42 and 44 such that the edge of the panel 54 abuts and compresses the preformed gasket 38 on insert 52. Another insert 56 is now located in place in mullion 54 in the same manner as described above with regard to insert 52. In accordance with the present invention it is critical that the angle Y between the first and second sections of the front wall 16 of the mullion 12 be at least 135° in order to locate legs 32 and 34 in place within the semi-circular slot 28 while maintaining the leg 30 out of the slot 28. Once located in the manner described above the mullion insert may then be rotated to its final position wherein it is held in place in slot 28 on mullion 12 by means of the legs 30, 32 and 34.

Thus, by way of the present invention an improved glazing system is provided wherein the entire system may be installed and glazed from the interior of the building thereby reducing the cost of installing a butt glazing system.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a building butt glazing system having a plurality of closely spaced adjacent panels secured to structural members by an adhesive the improvement comprising a vertical mullion structure having a front wall portion, a pair of sidewalls and a back wall portion, said front wall portion having a first pair of opposed sections extending from said pair of sidewalls toward each other in a plane substantially parallel to the plane made by said adjacent panels, a second pair of angled sections extending from said first pair of opposed sections toward said back wall portion so as to form an obtuse angle between the first pair of opposed sections and the second pair of angled sections and a third radial portion between and connecting said second pair of angled sections, said radial portion defining a semi-circular slot in said front wall portion facing said adjacent panels.

2. A glazing system according to claim 1 wherein said obtuse angle is greater than 135°.

3. A glazing system according to claim 1 including a removable mullion insert for sealing the space between said adjacent panels.

4. A glazing system according to claim 3 wherein said removable mullion insert comprises an elongated member being provided with securing means on one surface thereof for removably securing said insert in said semi-circular slot and sealing means on another surface thereof spaced from said one surface for sealing the space between said adjacent panels.

5. A glazing system according to claim 4 wherein said elongated member is a substantially T-shaped member having three short legs and one long leg wherein said securing means comprises the three short legs which are rotatably received in said semi-circular slot.

6. A glazing system according to claim 5 wherein said sealing means is secured to said one long leg.

7. In a building butt glazing system having a plurality of closely spaced adjacent panels secured to structural members by an adhesive, a method for sealing the space between said closely spaced adjacent panels comprising at least a first vertically disposed structural member, a second vertically disposed structural member spaced apart from said first structural member and a third vertically disposed structural member between said first structural member and said second structural member along a straight line therebetween, providing a slot on said at least third structural member, providing a removable mullion insert for sealing the space between said adjacent panels, said movable mullion insert having a first portion for securing said insert to said third structural member and a second portion for sealing the space between adjacent panels, locating a first panel in place relative to said first structural member and said third structural member, positioning said first portion of said insert in said slot on said third structural member, rotating said insert such that said second portion abuts the edge of said first panel and locating a second panel in place relative to said third structural member and said second structural member and adjacent to said first panel such that the edge of said second panel abuts said second portion of said insert so as to form a weather-tight seal between said panels.

8. A method according to claim 7 providing a gasket preform on said second portion of said insert.

9. A method according to claim 7 wherein said slot is a semi-circular slot.

10. A method according to claim 9 providing a three-pronged connection on said first portion of said insert which is received in said semi-circular slot.

11. A removable mullion insert for sealing the space between adjacent panels secured to structural members by means of adhesive in a butt glazing system comprising an elongated member having securing means on one surface thereof for removably securing said insert to the structural member of a butt glazing system and sealing means on another surface thereof spaced from said one surface for sealing the space between the adjacent panels.

12. A mullion insert according to claim 11 wherein said elongated member is a substantially T-shaped member having three short legs and one long leg wherein said securing means comprises the three short legs which are rotatably received in the structural mullion.

13. A mullion insert according to claim 12 wherein said sealing means is secured to said one long leg.

* * * * *